US007877027B2

(12) United States Patent
Furuyama

(10) Patent No.: US 7,877,027 B2
(45) Date of Patent: Jan. 25, 2011

(54) IMAGE FORMING APPARATUS AND PAPER DISCHARGE SPEED CONTROL METHOD FOR IMAGE FORMING APPARATUS

(75) Inventor: Noboru Furuyama, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/542,030

(22) Filed: Aug. 17, 2009

(65) Prior Publication Data

US 2010/0040385 A1 Feb. 18, 2010

Related U.S. Application Data

(60) Provisional application No. 61/089,781, filed on Aug. 18, 2008.

(51) Int. Cl.
*G03G 15/00* (2006.01)

(52) U.S. Cl. ..... 399/43; 399/68

(58) Field of Classification Search ..... 399/43, 399/67–70, 396
See application file for complete search history.

(56) References Cited

U.S. PATENT DOCUMENTS 5,481,346 A * 1/1996 Ohzeki et al. ..... 399/335
6,785,484 B2 * 8/2004 Nishiyama ..... 399/68
7,778,563 B2 * 8/2010 Eun et al. ..... 399/68

FOREIGN PATENT DOCUMENTS

JP 2005-202166 7/2005

* cited by examiner

*Primary Examiner*—Hoang Ngo
(74) *Attorney, Agent, or Firm*—Turocy & Watson, LLP

(57) ABSTRACT

A sheet temperature sensor which detects temperature of a recording medium that is fed is provided downstream in a sheet feeding direction from a fixing device. A controller counts the number of sheets on which an image is continuously formed, and controls the number of sheets discharged by the fixing device per unit time in accordance with the counted number of sheets and the temperature detected by the sheet temperature sensor.

21 Claims, 4 Drawing Sheets

| temperature / sheets | lower than 55℃ | 55℃– lower than 65℃ | 65℃– |
|---|---|---|---|
| 21– | 15cpm | 9cpm | 5cpm |
| 11–20 | 15cpm | 13cpm | 9cpm |
| 6–10 | 15cpm | 15cpm | 13cpm |
| –5 | 15cpm | 15cpm | 15cpm |

| temperature / sheets | lower than 55℃ | 55℃— lower than 65℃ | 65℃— |
|---|---|---|---|
| 21— | 15cpm | 9cpm | 5cpm |
| 11—20 | 15cpm | 13cpm | 9cpm |
| 6—10 | 15cpm | 15cpm | 13cpm |
| —5 | 15cpm | 15cpm | 15cpm |

IMAGE FORMING APPARATUS AND PAPER DISCHARGE SPEED CONTROL METHOD FOR IMAGE FORMING APPARATUS

CROSS-REFERENCE TO RELATED APPLICATIONS

This application is based upon and claims the benefit of priority from the prior the U.S.A. Patent Application No. 61/089,781, filed on Aug. 18, 2008, the entire contents of which are incorporated herein by reference.

TECHNICAL FIELD

The present invention relates to an image forming apparatus with improved print performance on coated papers.

BACKGROUND

An image forming apparatus such as a copy machine, MFP (multifunction peripheral) or printer may form an image on coated papers as well as ordinary copy papers. If the coating material of coated papers has a glass transition point similar to that of a developer including toner, coated papers stacked after an image is formed thereon may stick to each other.

A conventional image forming apparatus reduces the print speed in the case of forming an image on a coated paper (see, for example, JP-A-2005-202166). Therefore, there is a problem that the number of print sheets per unit time with respect to coated papers is lowered.

SUMMARY

It is an object of the present invention to provide an image forming apparatus that enables efficient image formation on a coated paper.

According to an aspect of the invention, an image forming apparatus for forming an image on a recording medium that is carried includes:

an image forming section which forms a developer image on an image carrier;

a transfer unit which transfers the developer image to the recording medium;

a fixing unit which heats and pressurizes the recording medium having the developer image transferred thereto by the transfer unit, and thus fixes the developer image to the recording medium;

a carrier which carries the recording medium having the developer image fixed thereto;

a sensor which is arranged downstream in a recording medium feeding direction from the fixing unit and detects temperature of the recording medium; and a controller configured to count the number of sheets of the recording medium on which an image is formed continuously, and controls a feeding speed of the recording medium in accordance with the number of sheets and the temperature detected by the sensor.

DETAILED DESCRIPTION

Throughout this description, the embodiments and examples shown should be considered as exemplars, rather than limitations on the apparatus and methods of the present invention.

Hereinafter, an embodiment of an image forming apparatus and a paper discharge speed control method for an image forming apparatus according to the invention will be described in detail with reference to the drawings.

Figure 1:
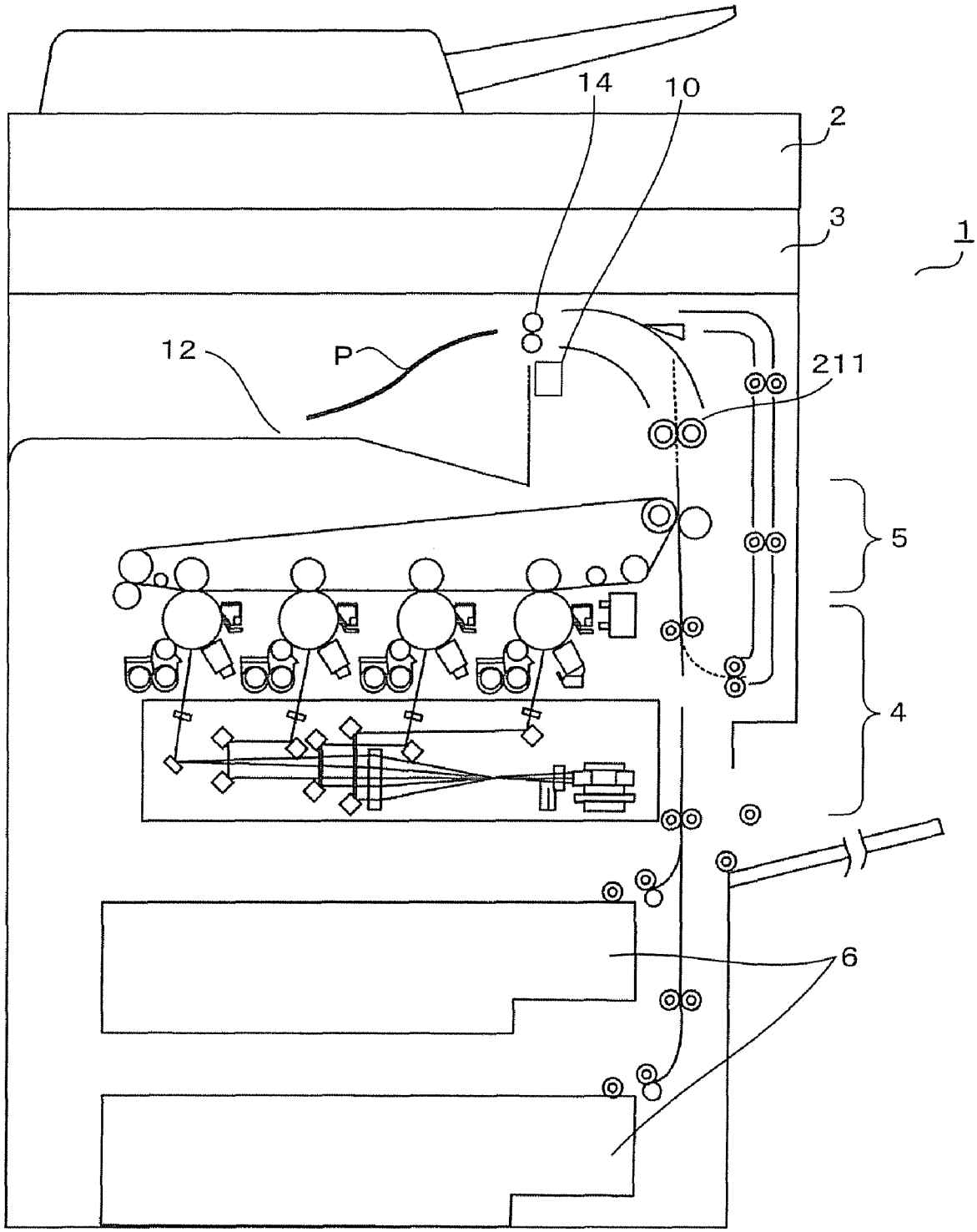
FIG. 1 shows the configuration of an image forming apparatus.

FIG. 1 shows the configuration of an image forming apparatus according to this embodiment. As shown in FIG. 1, an image forming apparatus 1 includes an automatic document feeder 2, an image scanning unit 3, an image forming section 4, a transfer unit 5, a sheet feeding mechanism, and a paper supply unit 6.

The automatic document feeder 2 is installed on top of the body of the image forming apparatus 1 in such a manner that the automatic document feeder 2 can open and close. The automatic document feeder 2 has a document feeding mechanism which takes out original documents one by one from the paper supply tray and feeds the original documents to the paper discharge tray.

The automatic document feeder 2, with the document feeding function, takes out original documents one by one and feeds the document to a document scanning unit of the image scanning unit 3. It is also possible to open the automatic document feeder 2 and place an original document on a document table of the image scanning unit 3.

The image scanning unit 3 has: a carriage including an exposure lamp which exposes an original document to light and a first reflection mirror; plural second reflection mirrors installed on a body frame of the image forming apparatus 1; a lens block; and a CCD (charge coupled device) of an image scanning sensor.

The carriage stands still at the document scanning unit or reciprocates below the document table and causes the first reflection mirror to reflect light of the exposure lamp reflected by an original document. The plural second reflection mirrors reflect the reflected light from the first reflection mirror to the lens block. The lens block changes the magnification of the reflected light and outputs the light to the CCD. The CCD converts the incident light to an electric signal and outputs the electric signal as an image signal to the image forming section 4.

The image forming section 4 has a laser irradiation unit, a photoconductive drum as an image carrier, and a developer supply unit.

The laser irradiation unit casts a laser beam to the photoconductive drum in accordance with the image signal and forms an electrostatic latent image on the photoconductive drum. The developer supply unit supplies a developer to the photoconductive drum and forms a developer image based on the electrostatic latent image.

The paper supply unit 6 takes out recording media one by one from a paper supply cassette and delivers the recording media to the sheet feeding mechanism. The sheet feeding mechanism feeds the recording media to the transfer unit 5.

The transfer unit 5 has a transfer belt, a transfer roller, and a fixing device 211. The transfer belt as an image carrier transfers thereto the developer image on the photoconductive drum and carries this developer image. The transfer roller, as a voltage is applied, transfers the developer image on the transfer belt to a recording medium that is fed. The fixing device 211 heats and pressurizes the developer image and thus fixes the developer image to the recording medium. The fixing device 211 further has a sheet temperature sensor 10 at a paper discharge port.

The recording medium discharged from the paper discharge port is loaded on a paper discharge tray 12 as a carrier which carries the recording medium.

Figure 2:
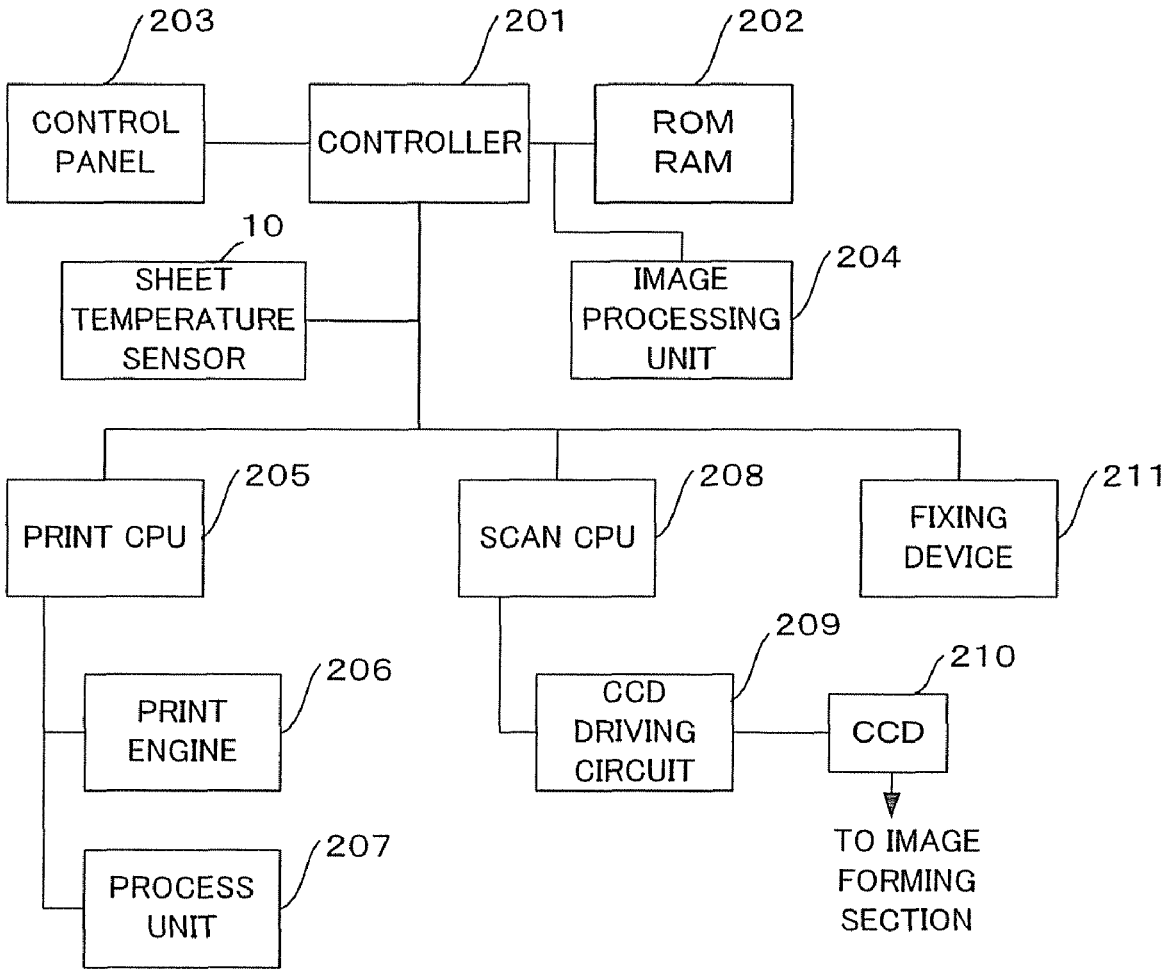
FIG. 2 is a schematic view showing the configuration of the image forming apparatus.

FIG. 2 is a schematic view showing the configuration of the image forming apparatus 1. As shown in FIG. 2, the image forming apparatus 1 has a controller 201 as an operation device which performs overall control of the entire image forming apparatus 1, a control panel 203 connected to the controller 201, a storage device 202, and an image processing unit 204 which processes images.

The controller 201 is connected to a print CPU 205 which controls each unit in an image forming system, a scan CPU 208 which controls each unit in an image scanning system, the sheet temperature sensor 10, and the fixing device 211. A detection value of the sheet temperature sensor 10 is inputted to the controller 201. The fixing device 211 is controlled by the controller 201.

The print CPU 205 controls a print engine 206 which forms an electrostatic latent image on the photoconductive drum, and a process unit 207 which forms a developer image.

The scan CPU 208 controls a CCD driving circuit 209 which drives a CCD 210. A signal from the CCD 201 is outputted to the image forming section 4.

Figure 3:
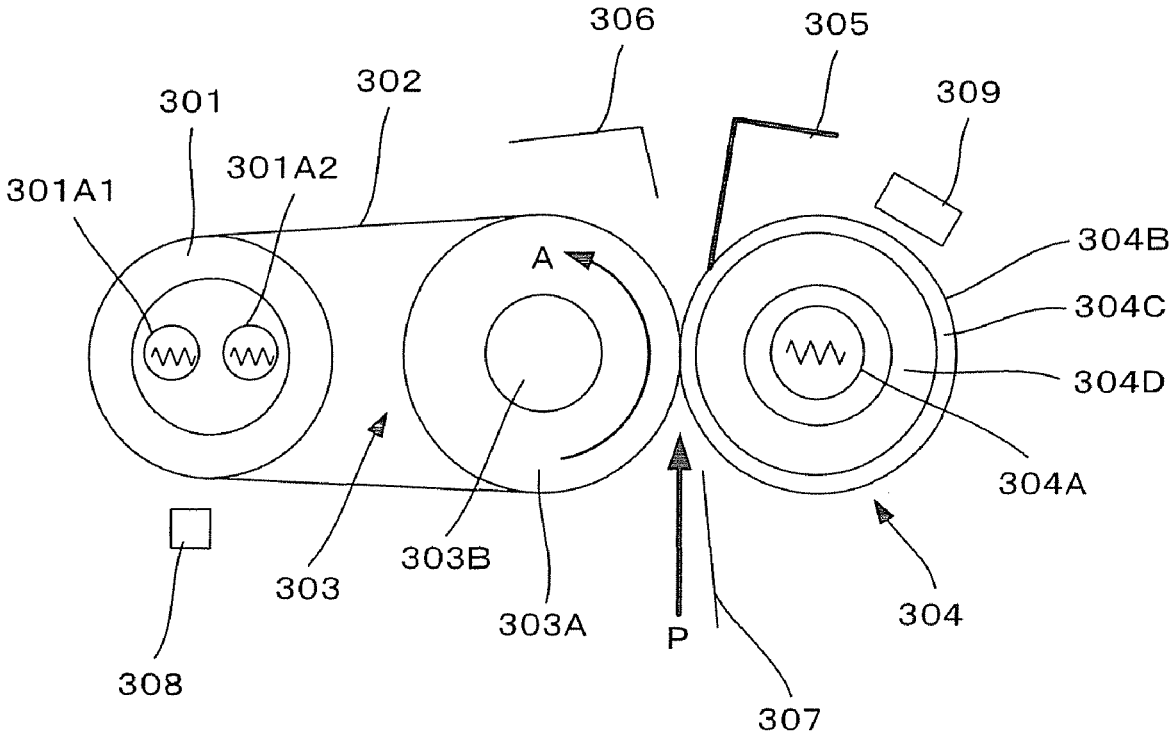
FIG. 3 is a side view showing essential parts of a fixing device.

FIG. 3 is a side view showing essential parts of the fixing device 211. As shown in FIG. 3, the fixing device 211 has a fixing unit. The fixing unit has a heating roller 301 which has a first heater lamp 301A1 and a second heater lamp 301A2 inside, a fixing belt 302 which transmits heat of the heating roller 301, a pressurizing roller 303 on which the fixing belt 302 is wound together with the heating roller 301, and a fixing roller 304 which is arranged facing the pressurizing roller 303 and pressurizes and heats a recording medium together with the pressurizing roller 303. The fixing roller 304 has a heater lamp 304A inside.

The fixing device 211 has an entrance guide 307 which guides a recording medium to a nip entrance between the pressurizing roller 303 and the fixing roller 304. The fixing device 211 has a separation pawl 305 which strips off a recording medium sticking to the fixing roller 304, and a separation guide 306 which guides the stripped recording medium, at a nip exit between the pressurizing roller 303 and the fixing roller 304.

The fixing device 211 has a heating roller temperature sensor 308 which detects the temperature of the heating roller 301, and a fixing roller temperature sensor 309 which detects the temperature of the fixing roller 304.

The fixing belt 302 uses a thin seamless belt formed by molding a metal such as nickel or a heat-resistant resin such as polyimide, as a base member, and the surface of the base member is coated with an oil-impregnated heat-resistant rubber such as silicone rubber or fluorine rubber, or a fluorine resin. Alternatively, the fixing belt 302 includes a silicone rubber coated with a heat-resistant highly releasable resin such as a PFA tube.

In this embodiment, the fixing belt 302 includes a thin seamless belt made of a 37-μm electroformed nickel, a heat-resistant elastic layer of silicone rubber applied on the outer circumferential surface of the seamless belt to a thickness of 200 μm, and a 30-μm thick PFA tube applied on the outer circumferential surface of the heat-resistant layer.

The heating roller 301 includes a core metal made of an aluminum pipe with a diameter of 30 mm and a thickness of 1 mm, coated with a 20-μm thick PTFE coating layer.

The pressurizing roller 303 has an outer diameter of 38 mm and a hardness of 35° (ASKER-C hardness). The pressurizing roller 303 includes a core metal 303B and a heat-resistant elastic body 303A made of an 8-mm thick silicone sponge applied on the outer circumferential surface of the core metal 303B. As the heat-resistant elastic body 303A, a sponge is desirable because the sponge has a high thermal insulation property and can secure a nip with a low load. However, a rubber may also be used.

A load of about 350 N is applied by a spring, not shown, to the pressurizing roller 303 from the fixing roller 304 via the fixing belt 302. The pressurizing roller 303 thus forms an 8.5-mm wide nip with the fixing roller 304.

The fixing roller 304 has an outer diameter of 40 mm and a hardness of 70° (ASKER-C hardness). The fixing roller 304 includes a core metal 304D made of a 2-mm thick aluminum pipe, a 2-mm thick silicone rubber (silicone rubber with a JIS-A hardness of 20°) 304C applied on the outer circumferential surface of the core metal 304D, and a 30-μm thick PFA tube 304B applied on the outer circumferential surface of the silicone rubber 304C. Within the fixing roller 304, a 300-W heater lamp 304A is arranged as a heat generating source.

The heat roller temperature sensor 308 is a thermopile that can detect temperature in a non-contact manner. The heating roller temperature sensor 308 is 4 mm away from the fixing belt 302 on the heating roller 301. A first heating roller temperature sensor is arranged near the center in the longitudinal direction of the heating roller 301. A second heating roller temperature sensor is arranged near the edges in the longitudinal direction of the heating roller 301. The heating roller temperature 308 detects the surface temperature of the fixing belt 302 wound on the outer circumferential surface of the heating roller 301. In accordance with this detected temperature, the first heater lamp 301A1 and the second heater lamp 301A2 are controlled.

The heating roller temperature sensor 308 may be a non-contact thermistor. Alternatively, the heating roller temperature sensor 308 may be a contact-type thermistor and installed on the surface of the heating roller 301.

The fixing roller temperature sensor 309 is a non-contact thermistor. In order to control the heater lamp 304A arranged within the fixing roller 304, the fixing roller temperature sensor 309 is arranged at a position that is 2 mm away from the surface of the fixing roller 304 and detects the surface temperature of the fixing roller 304.

The pressurizing roller 303 rotates in the direction of arrow A. A recording medium is fed from the direction of arrow P.

Figure 4:
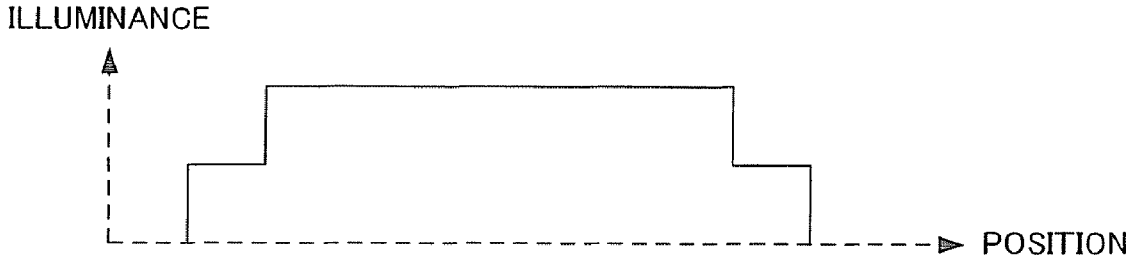
FIG. 4 shows illuminance distribution of a first heater lamp.

FIG. 4 shows illuminance distribution of the first heater lamp 301A1. As shown in FIG. 4, the illuminance distribution of the first heater lamp 301A1 shows a shape that is higher near the center in the longitudinal direction. The power consumption of the first heater lamp 301A1 is 600 W.

Figure 5:
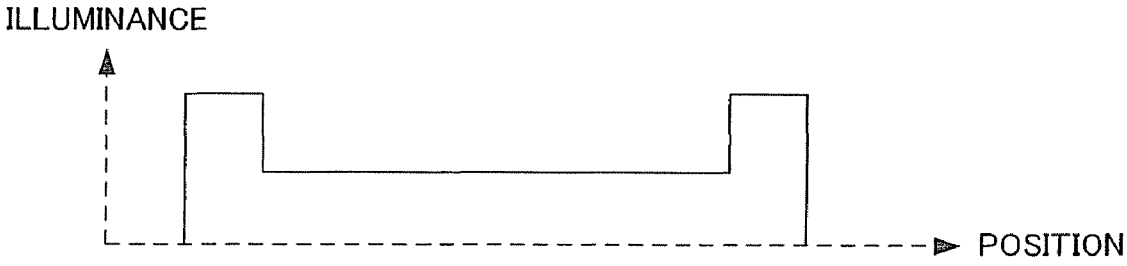
FIG. 5 shows illuminance distribution of a second heater lamp.

FIG. 5 shows illuminance distribution of the second heater lamp 301A2. As shown in FIG. 5, the illuminance distribution of the second heater lamp 301A2 shows a shape that is higher near the edges in the longitudinal direction. The power consumption of the second heater lamp 301A2 is 600 W.

A coated paper includes a paper as a base member coated with a resin. The resin layer has a glass transition point close to the glass transition point of toner so that the developer can be easily fixed.

Figures 6, 7:
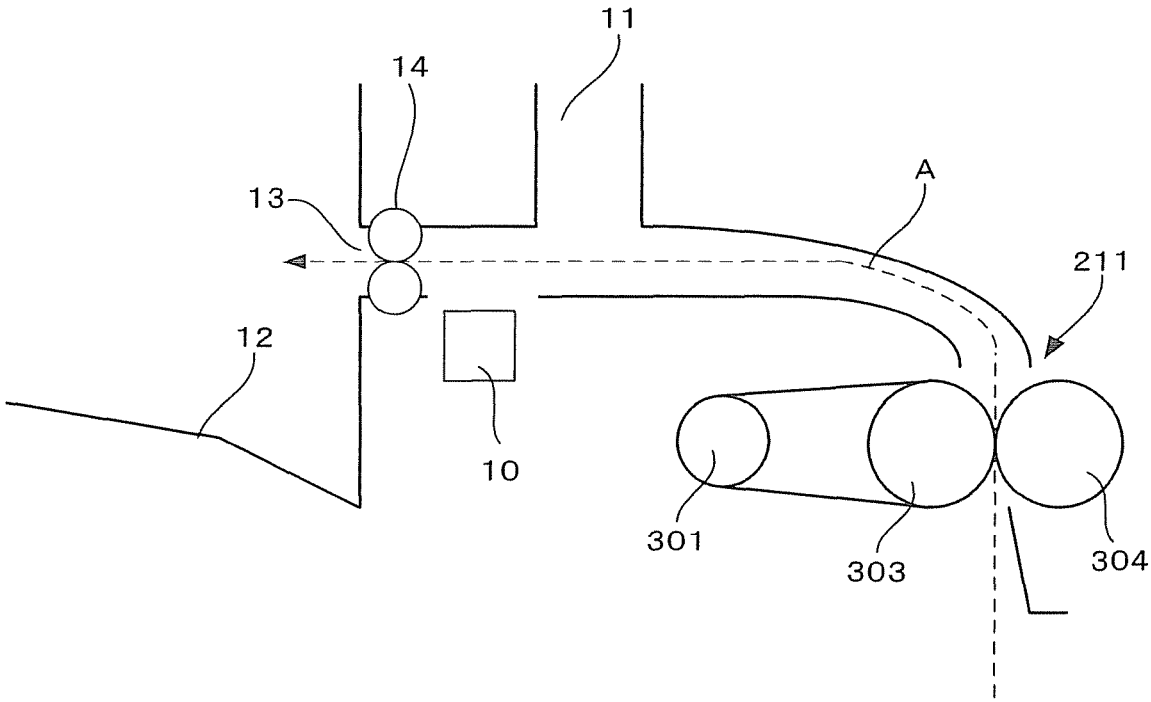
FIG. 6 is a side view showing the positional relation between the fixing device and a sheet temperature sensor.
FIG. 7 shows a control method for the fixing device by a controller.

FIG. 6 is a side view showing the positional relation between the fixing device 211 and the sheet temperature sensor 10. As shown in FIG. 6, the image forming apparatus 1 has the sheet temperature sensor 10 downstream in the sheet feeding direction from the fixing device 211. The image forming apparatus 1 has the sheet temperature sensor 10 at a paper discharge port 13 through which a recording medium with an image formed thereon is discharged. The image forming apparatus 1 has the sheet temperature sensor 10 upstream in the sheet feeding direction from paper discharge rollers 14.

It is desirable that the sheet temperature sensor 10 can detect the temperature of the fed recording medium in a non-contact manner. As the sheet temperature sensor 10, an infrared sensor, thermopile, or non-contact thermistor can also be used. A thermopile using infrared rays and having high responsiveness is desirable.

The sheet temperature sensor 10 may be arranged to the upper side or to the lower side of the recording medium that is fed. FIG. 6 shows an example where the sheet temperature sensor 10 is arranged to the lower side.

The sheet temperature sensor 10 is controlled in detection timing so as to detect the temperature of a margin part outside an image print area on the recording medium. This is because if the sheet temperature sensor 10 is an infrared sensor, the temperature cannot be accurately detected where a developer exists.

At the exit of the fixing device 211, a paper discharge sensor which detects discharge of the recording medium is provided. The sheet temperature sensor 10 measures temperature within a time period T from the paper discharge sensor detects the recording medium. This time period T is defined by the paper discharge sensor, the sheet temperature sensor 10 and the feeding speed of the recording medium.

If temperature is measured outside of the image print range on the recording medium, the time period T can be changed.

The recording medium with an image formed thereon is fed through a feeding path A after having the image fixed thereto by the fixing device 211. The recording medium is then loaded on the paper discharge tray 12 as a carrier which carries recording media. Downstream in the sheet feeding direction from the fixing device 211, a cooling duct 11 is provided before the sheet temperature sensor 10 and causes cooling air to blow the fed recording medium.

FIG. 7 shows a control method for the fixing device 211 by the controller 201. The sheet temperature sensor 10 detects the temperature of the recording medium that is discharged, and outputs the detected temperature to the controller 201. The controller 201 counts the number of sheets on which an image is formed.

The controller 201 determines the speed of discharging the recording medium with an image formed thereon, in accordance with the temperature detected by the sheet temperature sensor 10 and the number of sheets on which an image is formed.

The controller 201 controls at least the feeding speed of the recording medium to the paper discharge tray 12 as a carrier from the fixing unit of the recording medium. That is, the controller 201 can be configured to control the feeding speed of the feeding mechanism from the fixing device 211 to the paper discharge tray 12 without changing the fixing speed of the fixing device 211. Moreover, the controller 201 can be configured to control the paper discharge speed to the paper discharge tray 12 by controlling the fixing speed of the fixing device. Alternatively, the controller 201 can be configured to control the feeding speed of the feeding mechanism from the fixing device 211 to the paper discharge tray 12 by controlling the image forming speed of the image forming section 4.

As shown in FIG. 7, if the temperature of the recording medium that is discharged is lower than 55° C., the controller 201 performs control to discharge 15 sheets per minute.

If the temperature of the recording medium that is discharged is 55° C. or higher and less than 65° C., the controller 201 performs control to reduce the number of sheets discharged per minute as the number of sheets of recording media on which an image is continuously formed becomes greater. For example, the controller 201 controls the fixing device 211 so that if the number of sheets of recording media on which an image is continuously formed is five or fewer, 15 sheets are discharged per minute, whereas if the number of sheets of recording media on which an image is continuously formed is 11 or more and 20 or fewer, 13 sheets are discharged per minute.

If the temperature of the recording medium that is discharged is 65° C. or higher, the controller 201 performs control to further reduce the number of sheets discharged per minute as the number of sheets of recording media on which an image is continuously formed becomes greater. For example, the controller 201 controls the fixing device 211 so that if the number of sheets of recording media on which an image is continuously formed is five or fewer, 15 sheets are discharged per minute, whereas if the number of sheets of recording media on which an image is continuously formed is 11 or more and 20 or fewer, nine sheets are discharged per minute.

The controller 201 controls the number of rotations of the pressurizing roller 303 and the fixing roller 304 and thereby controls the number of sheets discharged per unit time.

The reason for such control is that sticking of coated papers with an image formed thereon depends on the temperature and the pressure by the stacked recording media. The fixing device 211 increases paper discharge intervals from an initial set value and thus lowers the temperature of coated papers with an image formed thereon.

As described above, the fixing device according to this embodiment and the image forming apparatus having this fixing device have the sheet temperature sensor 10 which detects the temperature of a recording medium that is discharged, downstream in the sheet feeding direction from the fixing device 211. The controller 201 counts the number of sheets on which an image is continuously formed and controls the number of sheets discharged by the fixing device 211 per unit time, in accordance with the counted number of sheets and the temperature detected by the sheet temperature sensor 10. Thus, the fixing device according to this embodiment and the image forming apparatus having this fixing device have an advantage that an image can be formed on a coated paper more efficiently.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus for forming an image on a recording medium that is carried comprising:

an image forming section which forms a developer image on an image carrier;

a transfer unit which transfers the developer image to the recording medium;

a fixing unit which heats and pressurizes the recording medium having the developer image transferred thereto by the transfer unit, and thus fixes the developer image to the recording medium;

a carrier which carries the recording medium having the developer image fixed thereto;

a sensor which is arranged downstream in a recording medium feeding direction from the fixing unit and detects temperature of the recording medium; and a controller configured to count the number of sheets of the recording medium on which an image is formed continuously, and controls a feeding speed of the recording medium in accordance with the number of sheets and the temperature detected by the sensor.

2. The apparatus according to claim 1, wherein the controller controls at least a feeding speed of the recording medium from the fixing unit of the recording medium to the carrier.

3. The apparatus according to claim 1, wherein the controller performs control so that the number of sheets discharged by the fixing unit per unit time becomes smaller as the temperature of the discharged recording medium becomes higher.

4. The apparatus according to claim 1, wherein the controller performs control so that the number of sheets discharged by the fixing unit per unit time becomes smaller as the number of sheets of the discharged recording medium becomes greater.

5. The apparatus according to claim 1, wherein the controller performs control so that the number of sheets discharged by the fixing unit per unit time becomes smaller as the temperature of the discharged recording medium becomes higher, and performs control so that the number of sheets discharged by the fixing unit per unit time becomes smaller as the number of sheets of the discharged recording medium becomes greater.

6. The apparatus according to claim 1, wherein the controller controls the number of rotations of the fixing unit, thereby performs control so that the number of sheets discharged by the fixing unit per unit time becomes smaller as the temperature of the discharged recording medium becomes higher, and performs control so that the number of sheets discharged by the fixing unit per unit time becomes smaller as the number of sheets of the discharged recording medium becomes greater.

7. The apparatus according to claim 1, wherein the fixing unit has a pair of pressurizing roller and fixing roller.

8. The apparatus according to claim 1, wherein the fixing unit comprises:

a heating roller having a heating mechanism inside;

a fixing belt which transmits heat of the heating roller;

a pressurizing roller on which the fixing belt is wound together with the heating roller; and a fixing roller which is arranged facing the pressurizing roller and pressurizes and heats the recording medium together with the pressurizing roller.

9. The apparatus according to claim 1, wherein the sensor is arranged upstream in a sheet feeding direction from a paper discharge roller which discharges the recording medium.

10. The apparatus according to claim 1, wherein the sensor is arranged to an upper side of the recording medium that is fed.

11. The apparatus according to claim 1, wherein the sensor is arranged to a lower side of the recording medium that is fed.

12. The apparatus according to claim 1, wherein the sensor detects the temperature of the recording medium that is fed, in a non-contact manner.

13. The apparatus according to claim 1, wherein the sensor is controlled in detection timing so as to detect temperature of a margin part outside an image print area on the recording medium.

14. A fixing method for a fixing device comprising:

by fixing unit, nipping a recording medium and heating and pressurizing the recording medium;

by a sheet temperature sensor, detecting temperature of the recording medium; and by a controller, counting the number of sheets of the recording medium on which an image is continuously formed, and controlling the number of sheets discharged by the fixing unit per unit time, in accordance with the counted number of sheets and the temperature detected by the sheet temperature sensor.

15. The method according to claim 14, wherein the controller performs control so that the number of sheets discharged by the fixing unit per unit time becomes smaller as the temperature of the discharged recording medium becomes higher.

16. The method according to claim 14, wherein the controller performs control so that the number of sheets discharged by the fixing unit per unit time becomes smaller as the number of sheets of the discharged recording medium becomes greater.

17. The method according to claim 14, wherein the controller performs control so that the number of sheets discharged by the fixing unit per unit time becomes smaller as the temperature of the discharged recording medium becomes higher, and performs control so that the number of sheets discharged by the fixing unit per unit time becomes smaller as the number of sheets of the discharged recording medium becomes greater.

18. The method according to claim 14, wherein the controller controls the number of rotations of the fixing unit, thereby performs control so that the number of sheets discharged by the fixing unit per unit time becomes smaller as the temperature of the discharged recording medium becomes higher, and performs control so that the number of sheets discharged by the fixing unit per unit time becomes smaller as the number of sheets of the discharged recording medium becomes greater.

19. The method according to claim 14, wherein the sheet temperature sensor detects the temperature of the recording medium that is fed, in a non-contact manner.

20. The method according to claim 14, wherein the sheet temperature sensor is controlled in detection timing so as to detect temperature of a margin part outside an image print area on the recording medium.

21. The method according to claim 14, wherein a pair of pressurizing roller and fixing roller of the fixing unit nips the recording medium, and heats and pressurizes the recording medium.

* * * * *